United States Patent [19]

Boulton et al.

[11] Patent Number: 4,493,759

[45] Date of Patent: Jan. 15, 1985

[54] ELECTROLYTIC CELL

[75] Inventors: Thomas W. Boulton; Brian J. Derwent, both of Frodsham, England

[73] Assignee: Imperial Chemical Industries PLC, Hertfordshire, England

[21] Appl. No.: 494,887

[22] Filed: May 16, 1983

[30] Foreign Application Priority Data

May 19, 1982 [GB] United Kingdom ..... 8214532

[51] Int. Cl.[3] ..... C25B 9/02; C25B 11/02; C25B 13/02

[52] U.S. Cl. ..... 204/252; 204/253; 204/279; 204/282

[58] Field of Search ..... 204/252-258, 204/263-266, 279, 282, 283; 156/380.2; 277/901, 166, 181, 186; 428/156

[56] References Cited

U.S. PATENT DOCUMENTS 4,175,025 11/1979 Creamer et al. ..... 204/253
4,253,932 3/1981 Mosé et al. ..... 204/253
4,274,939 6/1981 Bjäreklint ..... 204/257
4,368,109 1/1983 Ford ..... 204/253
4,379,814 4/1983 Tsien et al. ..... 429/42

OTHER PUBLICATIONS

Patents Abstracts of Japan vol. 4, No. 91, (E-17) (573), Jun. 28, 1980, p. 28E17 Japanese patent publication 55-56373.

*Primary Examiner*—Howard S. Williams
*Assistant Examiner*—T. L. Williams
*Attorney, Agent, or Firm*—Cushman, Darby & Cushman

[57] ABSTRACT

An electrolytic cell, and a gasket therefor, the cell comprising at least one anode and at least one cathode and a separator positioned between an anode and adjacent cathode and dividing the cell into separate anode and cathode compartments, the gasket comprising a plurality of projections and recesses on or in a surface thereof, and preferably on or in both surfaces thereof, adapted to cooperate with corresponding recesses and projections in or on a surface of an anode or cathode or a gasket adjacent thereto.

21 Claims, 6 Drawing Figures

ELECTROLYTIC CELL

This invention relates to an electrolytic cell and to a gasket for use in an electrolytic cell.

Electrolytic cells are known comprising a plurality of anodes and cathodes with each anode being separated from the adjacent cathode by a separator which divides the electrolytic cell into a plurality of anode and cathode compartments. The anode compartments of such a cell are provided with means for feeding electrolyte to the cell, suitably from a common header, and with means for removing products of electrolysis from the cell. Similarly, the cathode compartments of the cell are provided with means for removing products of electrolysis from the cell, and optionally with means for feeding water or other fluid to the cell.

The separator in the electrolytic cell may be a hydraulically permeable diaphragm which permits electrolyte to flow from the anode compartments to the cathode compartment of the cell, or it may be a substantially hydraulically impermeable membrane which is ionically permselective, for example, cation permselective, and which permits selective flow of ionic species between the anode compartments and the cathode compartments of the cell.

Such electrolytic cells may be used for example in the electrolysis of aqueous alkali metal chloride solutions. Where such a solution is electrolysed in an electrolytic cell of the diaphragm type the solution is fed to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolysed in an electrolytic cell of the membrane type containing a cation permselective membrane the solution is fed to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution may be fed, and hydrogen and alkali metal hydroxide solution produced by the reaction of alkali metal ions with hydroxyl ions are removed from the cathode compartments of the cell.

Electrolytic cells of the type described may be used particularly in the production of chlorine and sodium hydroxide by the electrolysis of aqueous sodium chloride solution.

A number of different constructions of electrolytic cell are known. For example, electrolytic cells of the filter press type may comprise a large number of alternating anodes and cathodes, for example, fifty anodes alternating with fifty cathodes, although the cell may comprise even more anodes and cathodes, for example up to one hundred and fifty alternating anodes and cathodes.

Such electrolytic cells may comprise a plurality of gaskets. For example, in an electrolytic cell of the filter press type one or more gaskets may be positioned between adjacent anodes and cathodes and may serve to electrically insulate the anodes and cathodes from each other and also serve to provide spacings in the cell to form the anode and cathode compartments.

In such electrolytic cells, and particularly in electrolytic cells of the filter press type comprising a large number of gaskets, difficulty may be experienced during the assembly of the cell in accurately positioning the gaskets, and in maintaining the gaskets in position when they are subjected to increased pressure. Furthermore, during use of the cell the gaskets may tend to slip with consequent danger of leakage of electrolyte from the cell.

The present invention relates to an electrolytic cell, and to a gasket for use in an electrolytic cell in which, during assembly of the cell and during use of the cell, the gaskets may readily be assembled in, and maintained in, a predetermined position in the electrolytic cell.

We are aware of U.S. Pat. No. 4,175,025 in which there is described a method of sealing a membrane to gaskets, referred to as plastics frames, in which, in an electrolytic cell of the filter press type a membrane is formed to fit between adjacent frames, the membrane having a surface area larger than that of the frames. In the cell a recess in one of the frames extends around the periphery of the frame and a gasket fits into the recess and bears against the adjacent frame to hold the membrane in position.

In an alternative embodiment each adjacent frame comprises a peripheral groove and a gasket is fitted into each groove, the membrane being clamped between the gaskets in the adjacent grooves.

According to the present invention there is provided an electrolytic cell comprising at least one anode and at least one cathode, a separator positioned between an anode and adjacent cathode and dividing the cell into separate anode and cathode compartments, and one or more gaskets of an electrically insulating material, characterised in that the gasket comprises a plurality of projections and/or recesses on or in a surface thereof adapted to co-operate with corresponding recesses and/or projections in or on a surface of an anode or cathode or a gasket adjacent thereto.

The invention is not limited to application to electrolytic cells of the filter press type. However, it is particularly suitable for application to such cells comprising a plurality of alternating anodes and cathodes and a plurality of gaskets as it is in such filter press cells that the difficulties of accurately positioning the gaskets and the danger of slippage of gaskets are most marked.

In the electrolytic cell a gasket may be positioned adjacent to an anode and/or a cathode in which case the projections and/or recesses on or in a surface of the gasket co-operate with corresponding recesses and/or projections in or on a surface of the anode and cathode. The gasket may be positioned between the adjacent anode and cathode.

The gaskets may have a frame-like construction the space inside of the frame providing in the electrolytic cell a space to form a part of an anode or cathode compartment.

Alternatively, the anodes and cathodes of the electrolytic cell may themselves be positioned in separate gaskets, for example each anode and cathode may be positioned in and be retained by a frame-like gasket, e.g. in a recess in the gasket. In this case the projections and/or recesses on or in a surface of a gasket co-operate with corresponding recesses and/or projections in or on a surface of another gasket adjacent thereto.

In general the gasket will be planar and it may comprise projections and/or recesses on or in one surface or both surfaces of the gasket, that is opposite surfaces.

It is preferred that the gasket comprises both projections and recesses on and in a surface thereof.

Thus, the gasket may comprise a plurality of projections and/or recesses on or in opposite surfaces thereof which are adapted to co-operate with corresponding recesses and/or projections in or on a surface of an anode and a cathode adjacent thereto, or of two gaskets adjacent thereto.

The gasket may comprise any suitable shape of projection on a surface thereof, and the recesses will have a shape designed to co-operate with the projections. For example, the projections may be in the form of studs on a surface of the gasket. The studs may be rectangular in shape, e.g. square or oblong shaped, or they may be cylindrical in shape. The recesses will be shaped so as to cooperate with the shape of the projections, and the recess may be provided by correspondingly shaped holes in the gasket which pass from one surface of the gasket to the other.

In a particular embodiment of the electrolytic cell of the invention each anode and each cathode, other than the terminal anode and cathode, are positioned between a pair of gaskets, the gaskets comprise a plurality of projections and/or recesses on or in at least a surface of the gaskets facing the anode or cathode, the anode or cathode comprise recesses in the surfaces thereof, and the projections on the surface of one or both of the gaskets pass through the recess in the anode or cathode and co-operate with corresponding recesses in the surface of the gasket on the opposite side of the anode or cathode.

The projections and/or recesses on and/or in the surface of the gasket should be so distributed as to provide the desired result of accurate positioning of the gasket during assembly of the electrolytic cell and should ensure that the gasket remains in its predetermined position in the cell during use of the cell.

In general the projections and/or recesses will be spaced apart by not more than 20 cm and they may even be spaced apart by as little as 2 cm. However, these spacing are intended to serve as a general guide and they are not intended to be limiting.

The thickness of the gasket will determine, at least in part, the dimensions of the anode or cathode compartment of the electrolytic cell. The gasket may for example have a thickness in the range 1 to 20 mm.

The projections should stand proud from the surface of the gasket by an amount sufficient to achieve the desired result of accurate positioning of the gasket during assembly of the electrolytic cell and should ensure that the gasket remains in its predetermined position in the cell during use of the cell. Thus, it is preferred that the projections form a relatively tight fit in the recess with which they co-operate.

The gaskets should be made of an electrically insulating material. It is desirable that the gaskets are flexible, and preferably resilient, in order to aid in achieving leak-tight seals in the electrolytic cell.

The gaskets are suitably made of an organic polymeric material which material may be, for example, a polyolefin e.g. polyethylene or polypropylene; a hydrocarbon elastomer, e.g. an elastomer based on ethylene-propylene copolymer, an ethylene-propylene-diene copolymer, natural rubber or a styrene-butadiene rubber; or a chlorinated hydrocarbon, e.g. polyvinyl chloride or polyvinylidene chloride. It is particularly desirable that the material of the gasket be chemically resistant to the liquors in the electrolytic cell, and when the cell is to be used in the electrolysis of aqueous alkali metal chloride solution the material may be a fluorinated polymeric material, for example polytetrafluoroethylene, polyvinyl fluoride, polyvinylidene fluoride, fluorinated ethylene-propylene copolymer tetra-fluoroethylene-hexa-fluoro-propylene copolymer, or a substrate having an outer layer of such a fluorinated polymeric material.

In a further embodiment of the present invention there is provided a gasket, for use in an electrolytic cell, the gasket comprising a plurality of projections and/or recesses on or in a surface thereof.

The separator in the electrolytic cell may be of the diaphragm or membrane type.

In the diaphragm type cell the separators positioned between adjacent anodes and cathodes to form separate anode compartments and cathode compartments are microporous and in use the electrolyte passes through the diaphragm from the anode compartments to the cathode compartments. Thus, in the case where aqueous alkali metal chloride solution is electrolysed the cell liquor which is produced comprises an aqueous solution of alkali metal chloride and alkali metal hydroxide. In the membrane type electrolytic cell the separators are essentially hydraulically impermeable and in use ionic species, or hydrated ionic species, are transported across the membranes between the compartments of the cell. Thus, where the membrane is a cation-exchange membrane cations are tranported across the membrane, and in the case where aqueous alkali metal chloride solution is electrolysed the cell liquor comprises an aqueous solution of alkali metal hydroxide.

Where the separator to be used in electrolytic cell is a microporous diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide produced in the electrolysis. Preferably, the microporous diaphragm is made of polytetrafluoro-ethylene, although other materials which may be used include, for example, tetrafluoro ethylene-hexafluoropropylene copolymers, vinylidene fluoride polymers and copolymers, and fluorinated ethylene-propylene copolymers.

Suitable microporous diaphragms are those described, for example, in U.K. Pat. No. 1,503,915 in which there is described a microporous diaghragm of polytetrafluoroethylene having a microstructure of nodes interconnected by fibrils, and in U.K. Pat. No. 1,081,046 in which there is described a microporous diaphragm produced by extracting a particulate filler from a sheet of polytetrafluoroethylene. Other suitable microporous diaphragms are described in the art.

Where the separator to be used in the cell is a cation-exchange membrane the nature of the membrane will also depend on the nature of the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in U.K. Pat. Nos. 1,184,321, 1,402,920, 14,066,673, 1,455,070, 1,497,748, 1,497,749, 1,518,387, and 1,531,068.

The separators may be secured in position in the electrolytic cell, for example, by fixing the separator to a gasket, or by clamping a separator between the surfaces of a pair of adjacent gaskets. The separator may for example be provided with a plurality of holes in the surface thereof through which the projections on the surface of a gasket adjacent thereto may be positioned. Such holes in the surface of the separator assist in correct positioning of the separator in the electrolytic cell.

The electrode in the electrolytic cell will generally be made of a metal or alloy and the nature of the metal or alloy will depend on whether the electrode is to be used as an anode or cathode and on the nature of the electrolyte which is to be electrolysed in the electrolytic cell.

Where aqueous alkali metal chloride solution is to be electrolysed and the electrode is to be used as an anode the electrode is suitably made of a film-forming metal or an alloy thereof, for example of zirconium, niobium, tungsten or tantalum, but preferably of titanium, and the surface of the anode suitably carries a coating of an electro-conducting electrocatalytically active material. The coating may comprise one or more platinum group metals, that is platinum rhodium, iridium, ruthenium, osmium or palladium, and/or an oxide of one or more of these metals. The coating of platinum group metal and/or oxide may be present in admixture with one or more non-noble metal oxides, e.g. titanium dioxide. Electro-conducting electrocatalytically active material for use as anode coatings in an electrolytic cell for the electrolysis of aqueous alkali metal chloride solution, and the methods of application of such coatings, are well known in the art.

Where aqueous alkali metal chloride solution is to be electrolysed and the electrode is to be used as a cathode the electrode is suitably made of iron or steel, or of other suitable metal, for example nickel. The cathode, may be coated with a material designed to reduce the hydrogen overpotential of the electrolysis.

The electrode may at least in part have a foraminate surface, for example, it may be a perforated plate, or it may have a mesh surface or surfaces, e.g a woven mesh, or it may comprise a plurality of spaced apart elongated members, e.g a plurality of strips which will generally be parallel to each other and vertically disposed in the electrolytic cell.

The electrolytic cell may be a monopolar cell or a bipolar cell, that is the cell may comprise individual anodes and cathodes separated from each other or the anodes and cathodes may be associated with each other in the form of bipolar electrodes.

In the electrolytic cell the anode compartments will be provided with means for feeding electrolyte to the compartments, suitably from a common header, and with means for removing products of electrolysis from the compartments. Similarly, the cathode compartments of the cell will be provided with means for removing products of electrolysis from the compartments, and optionally with means for feeding water or other fluid to the compartments, suitably from a common header.

For example, where the cell is to be used in the electrolysis of aqueous alkali metal chloride solution the anode compartments of the cell will be provided with means for feeding the aqueous alkali metal chloride solution to the anode compartments and with means for removing depleted aqueous alkali metal chloride solution from the anode compartments, and the cathode compartments of the cell will be provided with means for removing hydrogen and cell liquor containing alkali metal hydroxide from the cathode compartments, and optionally, and if necessary, with means for feeding water or dilute alkali metal hydroxide solution to the cathode compartments.

BRIEF DESCRIPTION OF THE DRAWINGS

The invention will now be described with the aid of the following drawings.

The detailed configuration of the whole of the gaskets and electrodes is not shown as such detailed configurations will be dependent on the particular construction of the electrolytic cell. The aforementioned drawings illustrate particular embodiments of the application of the principle of the invention which may be applied readily to any construction of electrolytic cell.

Figure 1:
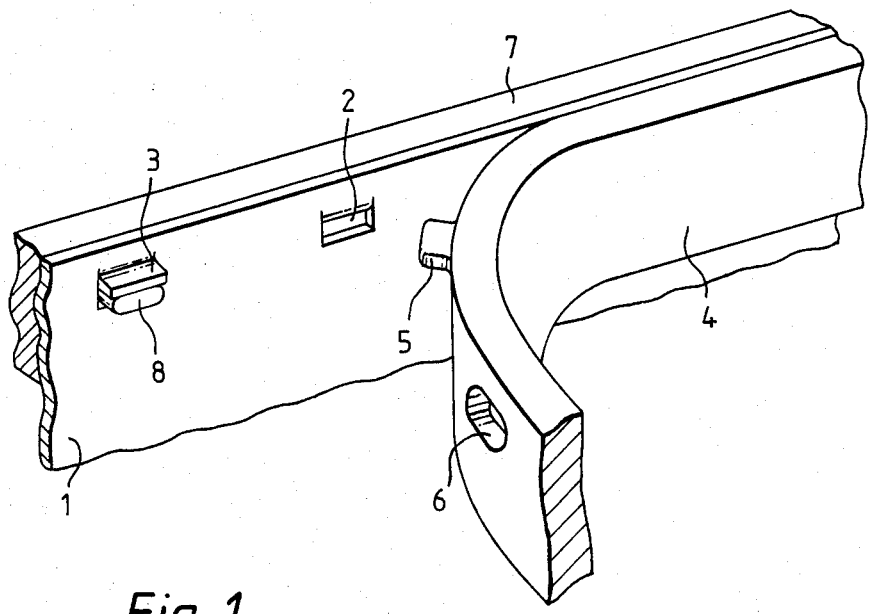
FIGS. 1, 3 and 5 show isometric views of a part of a metal electrode and an associated pair of gaskets which form a part of an electrolytic cell.
Figure 2:
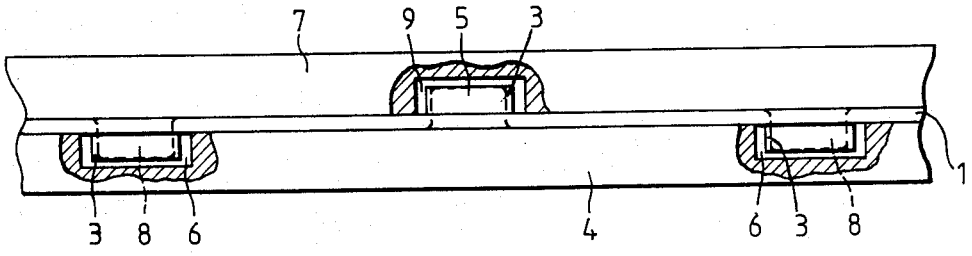
FIGS. 2, 4 and 6 show cross sectional views in plan of the part of a metal electrode and associated pair of gaskets shown respectively in FIGS. 1, 3 and 5 in an assembled form.

Referring to FIGS. 1 and 2 there is shown a metal electrode (1), in the form of a sheet, which may be anode or cathode in the electrolytic cell, the electrode comprising a plurality of holes (2) made by forming three slits in the surface of the electrode and folding back a lip (3) to a position approximately perpendicular to the surface of the electrode. The lips (3) are positioned alternately on one side and on the opposite side of the electrode.

The gasket (4) positioned on one side of the electrode (1) is made of an elastomeric ethylene-propylene-diene copolymer and comprises moulded projections (5) on the surface of the gasket. The gasket (7) positioned on the opposite side of the electrode (1) similarly comprises moulded projections (8) and recesses (9).

When assembled in the electrolytic cell the projections (5) on the surface of the gasket (4) pass through the holes (2) in the electrode (1) and into the recess (9) in the gasket (7) on the opposite side of the electrode (1). Similarly, the projections (8) on the gasket (7) pass through the holes (2) in the electrode (1) and into the recesses (6) in the gasket (4) on the opposite side of the electrode (1). The lips (3) are likewise positioned in the recesses (6) and (9) in the gaskets (4) and (7) respectively.

The gaskets (4, 7) may comprise recesses and projections on the surfaces thereof opposite to those surfaces carrying the projections (5) and recesses (6) and the projections (8) and recesses (9) respectively. These projections and recesses may then co-operate with holes and lips on electrodes placed adjacent to these opposite surfaces.

Figure 3:
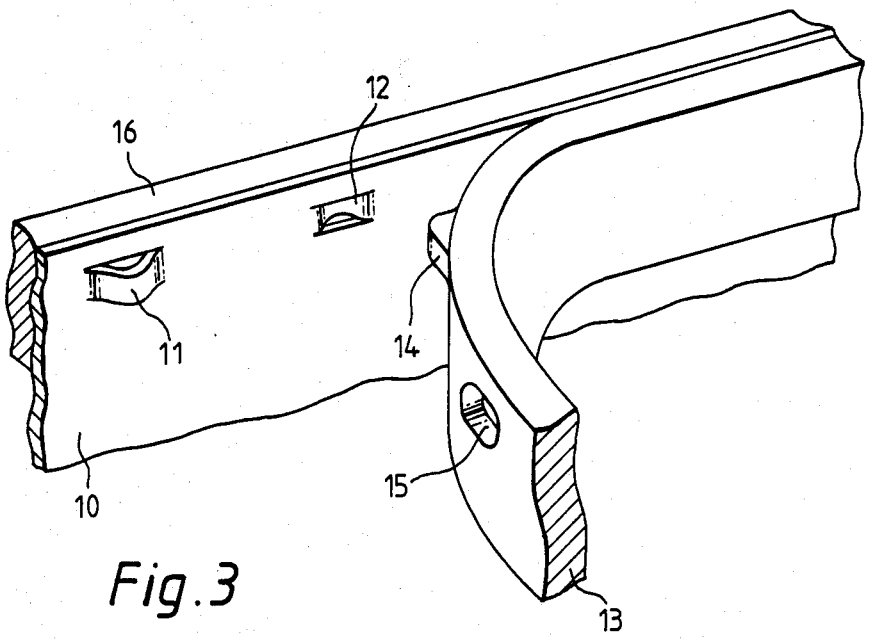
Figure 4:
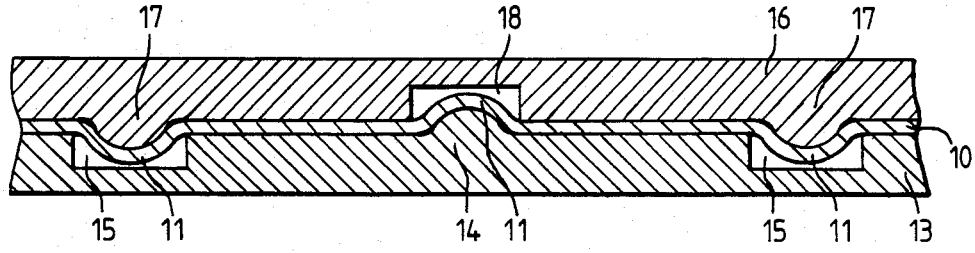

Referring to FIGS. 3 and 4 there is shown a metal electrode (10) in the form of a sheet comprising projections (11) and recesses (12) formed by making a pair of parallel slits in the sheet and displacing the part defined by the slits alternately to one side of the sheet and to the other. The gasket (13) positioned on one side of the electrode (10) comprises moulded projections (14) and recesses (15). Similarly, the gasket (16) positioned on the opposite side of the electrode (10 comprises moulded projections (17) and recesses (18).

When assembled in the electrolytic cell projections (14) and (17) on the surfaces of the gaskets (13) and (16) respectively are positioned in the recesses (12) of the electrode (10), and the projections (11) on the electrode (10) are positioned in the recesses (15) and (18) in the surfaces of the gaskets (13) and (16) respectively.

Figure 5:
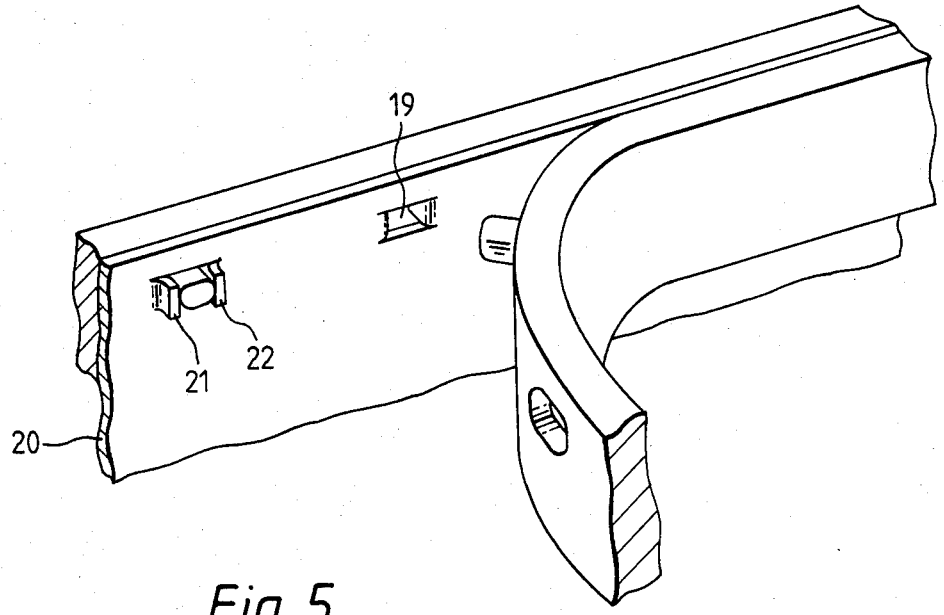
Figure 6:
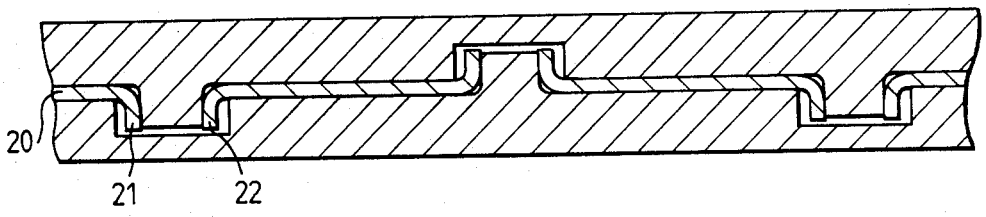

The embodiment shown in FIGS. 5 and 6 differs from that shown in FIGS. 1 and 2 only in the form of the recesses (19) in the electrode (20). The recesses (19) are each bounded by two upstanding lips (21) and (22) which project alternately in pairs to one side of the surface of the electrode and to the other side of the surface of the electrode.

We claim:

1. An electrolytic cell comprising at least one anode and at least one cathode, a separator positioned between an anode and adjacent cathode and dividing the cell into separate anode and cathode compartments, and at least one gasket of an electrically insulating material positioned between adjacent anodes and cathodes, characterized in that the gasket has a plurality of projections and recesses on or in a surface thereof adapted to co-operate with corresponding recesses and projections in or on a surface of an anode and/or of a cathode adjacent thereto.

2. An electrolytic cell as in claim 1 characterized in that the gasket is of planar frame-like construction having a space inside of the frame which forms a part of an anode or cathode compartment.

3. An electrolytic cell as in claim 1 characterized in that the projections and recesses on or in a surface of a gasket also co-operate with corresponding recesses and projections in or on a surface of another gasket adjacent thereto.

4. An electrolytic cell as in claim 1 characterized in that the gasket comprises projections and recesses on or in opposite surfaces of the gasket.

5. An electrolytic cell as in claim 1 characterized in that an anode or cathode are positioned between a pair of gaskets, the gaskets comprise a plurality of projections and recesses on or in at least the surfaces of the gaskets facing the anode or cathode, the anode or cathode comprises a plurality of recesses and projections in or on the surfaces thereof, and the projections on the surface of one or both of the gaskets pass through the recesses in the anode or cathode and co-operate with corresponding recesses in the surface of the gasket on the opposite side of the anode or cathode.

6. An electrolytic cell as claimed in claim 5 characterized in that the anode or cathode comprise a plurality of projections on a surface thereof which co-operate with corresponding recesses in the surface of a gasket adjacent thereto.

7. An electrolytic cell as in claim 1 characterized in that the projections and recesses on or in a surface of a gasket are spaced apart by a distance in the range 1 to 20 cm.

8. An electrolytic cell as in claim 1 characterized in that the gasket has a thickness in the range 1 to 20 mm.

9. An electrolytic cell as in claim 1 characterized in that the gasket is made of a resilient material.

10. An electrolytic cell as in claim 1 characterized in that the separator is a microporous diaphragm.

11. An electrolytic cell as in claim 1 characterized in that the separator is a cation-exchange membrane.

12. An electrolytic cell as in claim 1 characterized in that the separator is clamped between the surfaces of a pair of adjacent gaskets.

13. An electrolytic cell as in claim 1 characterized in that the cell is a filter press cell comprising a plurality of alternating anodes and cathodes and one or more gaskets positioned between adjacent anodes and cathodes.

14. An electrolytic cell as in claim 13 characterized in that the gasket is of planar frame-like construction having a space inside of the frame which forms a part of an anode or cathode compartment.

15. An electrolytic cell as in claim 13 characterized in that the projections and recesses on or in a surface of a gasket also co-operate with corresponding recesses and projections in or on a surface of another gasket adjacent thereto.

16. An electrolytic cell as in claim 13 characterized in that the projections and recesses on or in a surface of a gasket are spaced apart by a distance in the range 1 to 20 cm.

17. An electrolytic cell as in claim 13 characterized in that the gasket has a thickness in the range 1 to 20 mm.

18. An electrolytic cell as in claim 13 characterized in that the gasket is made of a resilient material.

19. An electrolytic cell as in claim 13 characterized in that the separator is a microporous diaphragm.

20. An electrolytic cell as in claim 13 characterized in that the separator is a cation-exchange membrane.

21. An electrolytic cell as in claim 13 characterized in that the separator is clamped between the surfaces of a pair of adjacent gaskets.

* * * * *